US009943144B2

(12) United States Patent
Mezhibovsky et al.

(10) Patent No.: US 9,943,144 B2
(45) Date of Patent: Apr. 17, 2018

(54) STEP-CUT GEMSTONE

(71) Applicants: Leon Mege Inc., New York, NY (US); GemConcepts Ltd., Ramat-Gan (IL)

(72) Inventors: Leonid Mezhibovsky, New York, NY (US); Yoram Finkelstein, Caesarea (IL)

(73) Assignees: Leon Mege Inc., New York, NY (US); GemConcepts, Ltd., Ramat-Gan (IL)

( * ) Notice: Subject to any disclaimer, the term of this patent is extended or adjusted under 35 U.S.C. 154(b) by 299 days.

(21) Appl. No.: 14/802,182

(22) Filed: Jul. 17, 2015

(65) Prior Publication Data

US 2016/0120274 A1 May 5, 2016

Related U.S. Application Data

(63) Continuation-in-part of application No. 29/507,932, filed on Oct. 31, 2014, now Pat. No. Des. 741,214, and a continuation-in-part of application No. 29/507,940, filed on Oct. 31, 2014, now Pat. No. Des. 746,169.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001
USPC ..... 63/32; D11/90
See application file for complete search history.

(56) References Cited

U.S. PATENT DOCUMENTS

| | | | | |
|---|---|---|---|---|
| 4,020,649 | A | 5/1977 | Grossbard | |
| 4,020,694 | A | 5/1977 | Mayhew | |
| 4,118,949 | A | 10/1978 | Grossbard | |
| 4,118,950 | A | 10/1978 | Grossbard | |
| 4,555,916 | A | 12/1985 | Grossbard | |
| 5,186,024 | A | 2/1993 | Waters, Jr. | |
| 5,970,744 | A * | 10/1999 | Greeff | A44C 17/001 63/32 |
| D422,934 | S | 4/2000 | Quijo | |
| D442,112 | S | 5/2001 | Pecker | |
| D442,114 | S | 5/2001 | Greeff | |
| D453,007 | S | 1/2002 | Asscher | |
| 6,363,745 | B1 | 4/2002 | Greeff | |
| 6,449,985 | B1 | 9/2002 | Kejejian | |
| D479,148 | S | 9/2003 | Fortgang | |

(Continued)

FOREIGN PATENT DOCUMENTS

| | | |
|---|---|---|
| BE | 20110452 | 7/2011 |
| EM | 002620047-0001 | 1/2015 |

(Continued)

*Primary Examiner* — Jack W Lavinder
(74) *Attorney, Agent, or Firm* — Banner & Witcoff, Ltd.

(57) ABSTRACT

A cushioned step-cut gemstone is disclosed. The gemstone may include a crown disposed above a girdle and a pavilion disposed below the girdle. The girdle may include twelve straight-edged facets defining four sides and four corners of the girdle, wherein the four sides each comprise one straight-edged facet and the four corners each comprise two straight-edged facets meeting at a corner midpoint. The crown may include a table and two or more rows of step-cut facets between the table and the girdle. The step-cut facets may include side step-cut facets shaped like elongated trapezoids and corner step-cut facets, and each step-cut row includes twelve step-cut facets.

18 Claims, 5 Drawing Sheets

(56) References Cited

U.S. PATENT DOCUMENTS

| | | | |
|---|---|---|---|
| D484,824 | S | 1/2004 | Namdar |
| D484,825 | S | 1/2004 | Mehta |
| D489,284 | S | 5/2004 | Sung et al. |
| D490,742 | S | 6/2004 | Kejejian |
| D491,837 | S | 6/2004 | Fortgang |
| D494,086 | S | 8/2004 | Lax |
| D496,300 | S | 9/2004 | Polack et al. |
| D499,981 | S | 12/2004 | Namdar |
| D500,961 | S | 1/2005 | Krochmal |
| D501,644 | S | 2/2005 | Siman-Tov et al. |
| D503,651 | S | 4/2005 | Kejejian |
| D503,652 | S | 4/2005 | Atlass et al. |
| D522,401 | S | 6/2006 | Rydlewicz |
| D524,687 | S | 7/2006 | Moller et al. |
| D537,379 | S | 2/2007 | Namdar |
| D549,611 | S | 8/2007 | Unterbrunner et al. |
| 7,260,544 | B1 | 8/2007 | Reinitz et al. |
| D550,115 | S | 9/2007 | Pandya et al. |
| D551,590 | S | 9/2007 | Winkler |
| D566,609 | S | 4/2008 | Novikov |
| D569,297 | S | 5/2008 | Shah |
| D607,770 | S | 1/2010 | Swarovski |
| D610,941 | S | 3/2010 | So |
| D641,281 | S | 7/2011 | Itkowitz |
| D641,282 | S | 7/2011 | Itkowitz |
| D641,284 | S | 7/2011 | Itkowitz |
| 8,156,760 | B2 | 4/2012 | Gad |
| D661,617 | S | 6/2012 | Siman-Tov et al. |
| D665,698 | S | 8/2012 | Mistry et al. |
| 8,297,075 | B2 | 10/2012 | Weitman |
| 8,616,192 | B2 | 12/2013 | Vets |
| 8,707,733 | B2 | 4/2014 | Weingarten |
| D704,092 | S | 5/2014 | Holloway et al. |
| 8,844,319 | B2 | 9/2014 | Weingarten |
| 2002/0170315 | A1 | 11/2002 | Mardkha |
| 2006/0074588 | A1 | 4/2006 | Blodgett et al. |
| 2007/0113586 | A1 | 5/2007 | Rydlewicz |
| 2012/0227444 | A1 | 9/2012 | Froehlich et al. |
| 2012/0297826 | A1 | 11/2012 | Husar et al. |
| 2014/0116088 | A1 | 5/2014 | Weitman |
| 2014/0290638 | A1 | 10/2014 | Mehta |

FOREIGN PATENT DOCUMENTS

| | | | | |
|---|---|---|---|---|
| EM | 002620047-0002 | | 1/2015 | |
| EP | 11167969.2 | | 5/2011 | |
| SU | 001743563 | A1 * | 6/1992 | ..... A44C 17/001 |
| WO | 20061087702 | A1 | 8/2006 | |

* cited by examiner

STEP-CUT GEMSTONE

RELATED APPLICATIONS

This U.S. patent application claims priority to U.S. patent application Ser. No. 29/507,940, filed Oct. 31, 2014, entitled "Gemstone," and U.S. patent application Ser. No. 29/507,932, filed Oct. 31, 2014, entitled "Gemstone," where these applications are incorporated by reference as if fully set forth herein.

TECHNICAL FIELD

Aspects of the disclosure relate to cut gemstones and methods of cutting gemstones, including, in certain aspects, cut gemstones such as diamonds. The cut of the gemstone in the disclosure enhances the visual properties and light reflectivity of the gemstone or diamond, including light exiting through the table facet.

BACKGROUND

Gemstone cuts, in particular for diamonds, are styles, patterns, templates, or designs used to cut and shape gemstones. A cut may take into account symmetry, proportioning, sizing, shape, and polishing of a gemstone. The type and style of the cut is a significant factor that influences a diamond's or other gemstone's light reflectivity and as a result, the brilliance or luminescence. The overall appearance of a gemstone or diamond can be enhanced by cutting the gemstone or diamond into different shapes and polishing the surface of the gemstone or diamond.

Based upon the shape and size of a diamond or other gemstone, a particular cut may be chosen that will determine the placement of various symmetrical facets. Placement of the facets and other cut shapes around the outer surface of the gemstone will ultimately influence the amount of light that will be reflected from the interior and exterior of the gemstone.

Most gemstones and in particular, diamonds, are unremarkable when initially recovered during the mining process. The gemstones may contain other types of natural deposits and may have an opaque or dull appearance. The subsequent cutting and polishing of the gemstone can radically transform its appearance and improve light reflectivity. By modifying the shape, light entering the gemstone can be redirected to maximize where the light exits the gemstone. This redirection of light enhances the sparkle or brilliance of a gemstone.

Stone cutters consider various factors when designing a particular cut. One consideration is the refractive index ("RI") of a diamond or gemstone and another is the dispersive power of the diamond or gemstone. RI of a diamond or other gemstone is typically measured by sodium light and influences the brilliance of the gemstone. Brilliance is the amount of light reflected from the gemstone or diamond to the viewer. The dispersive power is the ability of the gemstone or diamond to separate light into individual spectral components. This is known as fire.

Once a gemstone is cut, the facets may form the exterior surface of the stone. The facets may also form the shape, design, or figure on the gemstone. Many diamonds will have a top crown section, a middle girdle section, and a lower pavilion section. The crown may include a top or table and a culet can be included at the nadir of the pavilion. Each section may be subdivided into other sections and cut as desired, forming a plurality of facets, shapes, and patterns.

There are numerous popular gemstone cuts, including, for example, the "round brilliant" and the "passion cut." Gemstones with a rectangular or square shape can be cut to include a "step-cut." The step-cut includes facets that are rectilinear and arranged in parallel to the girdle in the horizontal plane. The corners can be truncated creating an octagonal outline, for example, in the "emerald cut." As described by these representative examples, numerous gemstone cuts are known in the art, including many cuts that provide relatively high brilliance, RI, and/or fire to a viewer.

SUMMARY

This Summary provides an introduction to some general concepts relating to this disclosure in a simplified form that are further described below in the Detailed Description. This Summary is not intended to identify key features or essential features of the disclosure.

Certain aspects of the present disclosure relate to unique gemstone cuts, or methods of making such cut gemstones. In accordance with one exemplary aspect of the disclosure, a cushion step-cut is described for a square-shaped gemstone or diamond. In examples of this aspect, the gemstone comprises a crown disposed above the girdle and a pavilion disposed below the girdle. In some embodiments, the girdle comprises twelve straight-edged facets defining four sides and four corners of the girdle, wherein the four sides each comprise one straight-edged facet and the four corners each comprise two straight-edged facets meeting at a corner midpoint. In various examples, the crown comprises a table and two or more rows of step-cut facets between the table and the girdle. In certain embodiments, the rows of step-cut facets include side step-cut facets that have an elongated trapezoid shape and corner step cut facets. In various examples, each row consists of twelve step-cut facets.

Certain aspects of the disclosure relate to a cut gemstone with a girdle that has twelve straight-edged facets defining four sides and four corners of the girdle. In some of these examples the four sides each comprise one straight-edged facet. In certain embodiments the four corners each comprise two straight-edged facets. In other examples the pavilion includes four corners and each pavilion corner includes an elongated pentagonal facet that includes a point meeting a corner midpoint, and three triangular facets. In various embodiments, the crown includes a table and two or more rows of step-cut facets between the table and the girdle.

In another aspect of the disclosure, a cushion step-cut is described for a gemstone that is square. In another aspect of the disclosure the gemstone may be a rectangle. In yet another aspect of the disclosure, the gemstone may be an irregular shape. In some embodiments, a gemstone cut consists of 78 total facets. In other various embodiments, the facet template or pattern includes 37 crown facets, the girdle includes 12 facets, and the pavilion includes 29 facets.

BRIEF DESCRIPTION OF THE DRAWINGS

Exemplary embodiments of the disclosure will now be described by way of example only and with reference to the accompanying drawings, in which.

DETAILED DESCRIPTION OF EMBODIMENTS

In the following description of various examples of the gemstone cut of this disclosure, reference is made to the accompanying drawings, which form a part hereof.

It is to be understood that other gemstone cuts may be utilized and that structural and functional modifications may be made from the specifically described examples without departing from the scope of the present disclosure. Moreover, the figures of this disclosure may represent the scale and/or dimensions according to one or more embodiments, and as such contribute to the teaching of such dimensional scaling. However, those skilled in the art will readily appreciate that the disclosure herein is not limited to the scales, dimensions, proportions, and/or orientations shown in the figures.

The embodiments described herein provide, inter alia, a cushion step-cut gemstone. The cut gemstone may be used to maximize the refractive index and the dispersive power of the gemstone. Increasing the described properties of the gemstone may increase the appeal and the beauty of the stone.

The proportions of this new three-dimensional step-cut design will produce a unique visual play of light that is different from the visuals created by other generic step-cut proportions. Traditionally, step-cut facet designs reflect light in a manner that mimics long flashes of light returns caused by the elongated nature of the facet shapes and other proportions. This present embodiments incorporate a relativity high crown height that is harmonious with a significantly smaller table facet. These features, in coordination with specific design proportions, may provide a relatively unique play of light. Compared to other generic step-cut designs, examples of this disclosure may also provide an evenly scattered face-up appearance, created by slow to fast events of medium to large blocky white light and colored fire flashes that work in harmony due to the gemstone's unique proportions. The creation of additional virtual-facets presents the viewer with the ability to visualize the scintillating effects of the gemstone that are minimal in a generic step-cut design.

The designs of various examples may provide the "Kozibe-effect." This is a reflected spread of a faceted culet visible through crown and table facets, which adds character to the visual display of the gemstone. The faceted culet may also provide a durability feature, as pointed culets are prone to chipping and typically require a full re-cut of the diamond if the culet is chipped, but, in these examples, it is simple to retouch the diamond with a medium-sized open culet in the case a culet is chipped. Another visual effect that may result from the unique design and proportions of certain embodiments is the "Three Dimensional Sculpture" effect, which intensifies the crown facet external light reflection. This may provide a sculptured appearance when the gemstone is set in jewelry.

Figure 1:
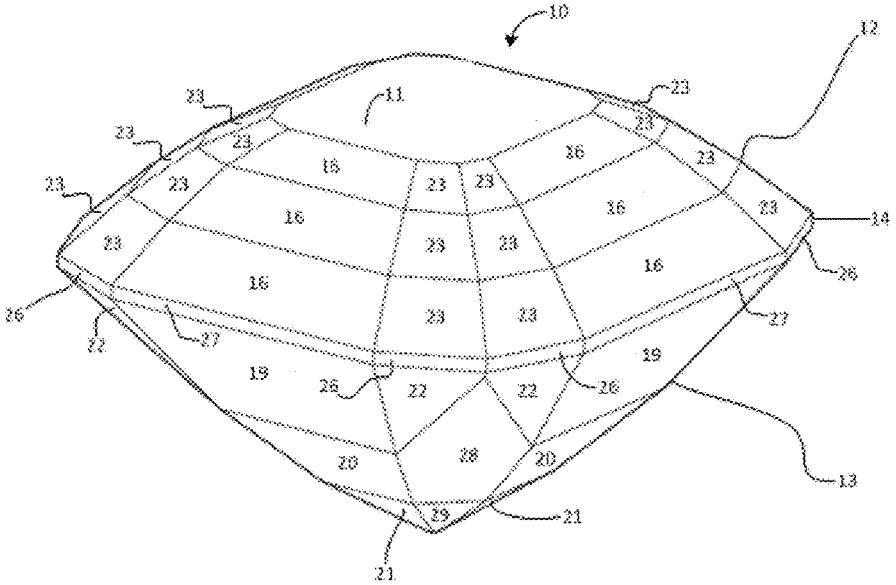
FIG. 1 shows a top, front, right perspective view of an exemplary embodiment of a cushion step-cut gemstone.
Figure 2:
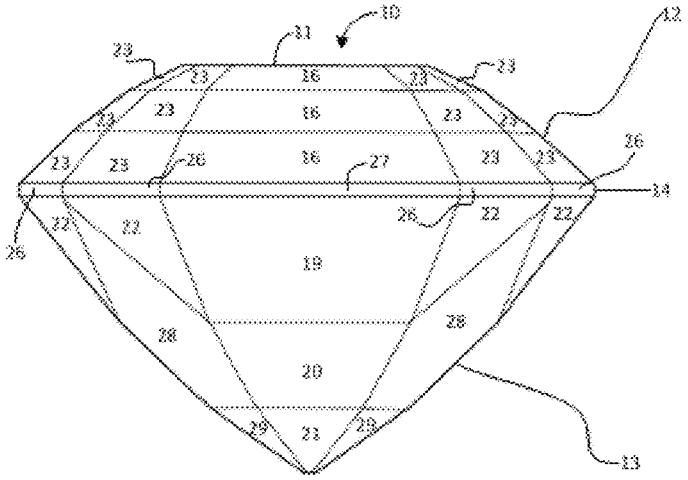
FIG. 2 shows a front view of an exemplary embodiment of a cushion step-cut gemstone.

In some examples, the gemstone comprises a girdle, a crown disposed above the girdle, and a pavilion disposed below the girdle. The girdle may comprise a plurality of straight-edged facets. In certain examples, such as the examples of FIGS. 1 and 2, the girdle 14 comprises twelve straight-edged facets 26 and 27. The crown may comprise a plurality of step-cut facets and a table. In certain examples, such as the examples of FIGS. 1 and 2, the crown 12 consists of trapezoidal step-cut facets 16, a table 11, and smaller or truncated, corner trapezoidal step-cut facets 23 (where each row may comprise side step-cut facets, such as the trapezoidal facets 16, and corner step-cut facets, such as corner facets 23). The pavilion may comprise a plurality of facets, including a plurality of pentagonal and triangular facets. In certain examples, such as the examples of FIGS. 1 and 2, each corner of the pavilion 13 includes an elongated or stretched pentagonal facet 28, two upper triangular facets 22, and one lower triangular facet 29. The pavilion may further include side facets, such as trapezoidal facets 19 and 20 as well as triangle facet 21.

Figure 4:
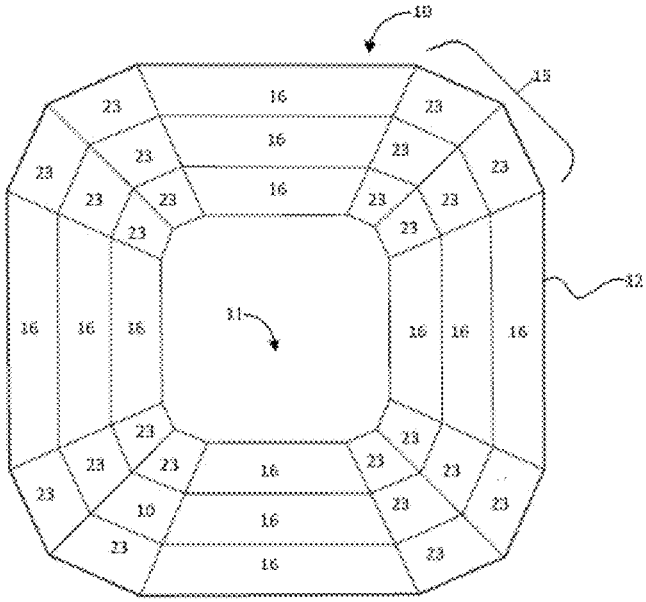
FIG. 4 shows a top view from directly above an exemplary embodiment of a cushion step-cut gemstone.

In some exemplary embodiments, such as the exemplary embodiment of FIG. 4, the crown 12 comprises a table 11 and three rows of step-cut facets (such as facets 16). In other examples, the crown may comprise a different number of rows of step-cut facets, for example two or more rows of step cut facets, or four rows of step cut-facets. The gemstone side step-cut facets 16, in one particular embodiment, are shaped like elongated trapezoids. The four crown corners 15 may each comprise two step-cut facets for each row of step-cut facets, and in the exemplary embodiment of FIG. 4 are composed of six step-cut facets 23. The corner step-cut facets 23, in one particular embodiment, are shaped like irregular trapezoids. In some examples, such as the embodiments shown in FIG. 4, the step-cut facets forming the rows may comprise both regular and irregular trapezoids. In an exemplary embodiment, each step-cut row includes twelve step-cut facets. In one example, a gemstone with three step-cut rows has 36 step-cut facets. In yet another example, the gemstone has two step-cut rows and has 24 step-cut facets.

Some embodiments include a faceted culet. For example, the embodiments of FIGS. 5 and 6 include a single culet 17. The gemstone cutter may create the culet 17 by cutting off or removing the tip of the stone. In other exemplary embodiments, however, the gemstone does not have a culet.

Figure 5:
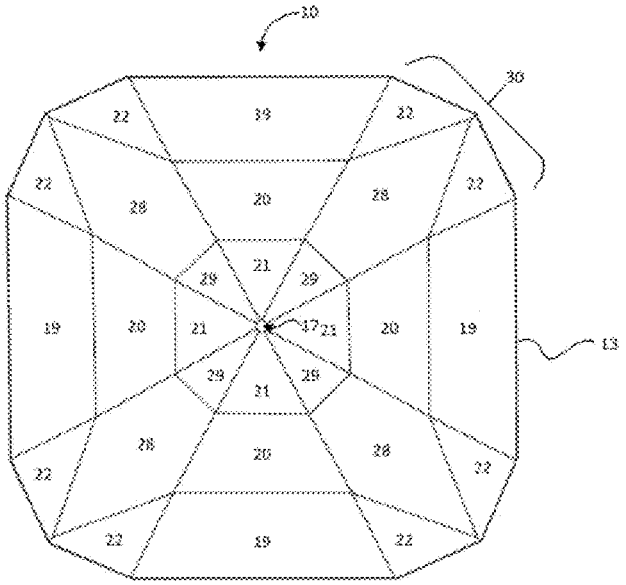
FIG. 5 shows a bottom view from directly below an exemplary embodiment of a cushion step-cut gemstone.
Figure 6:
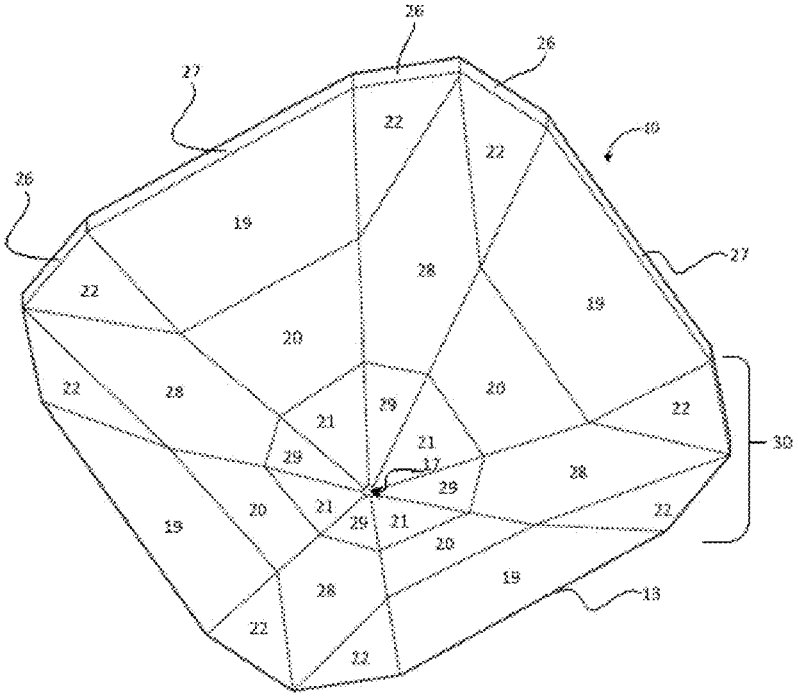
FIG. 6 shows a bottom, front, right perspective view an exemplary embodiment of a cushion step-cut gemstone.

The examples of FIGS. 5 and 6 include a single culet 17, and the girdle consists of twelve rectangular facets consisting of eight small rectangle facets 26 that form part the top of pavilion corner 30, and four larger rectangles 27. The four pavilion corners 30 further include upper two triangle facets 22 in contact with the girdle, an elongated or stretched pentagonal facet 28, and a single lower triangle facet 29 in contact with the culet. The pavilion 13 further includes four sides each consisting of a large trapezoid facet 19, a small trapezoid facet 20, and a triangle facet 21.

Figure 3:
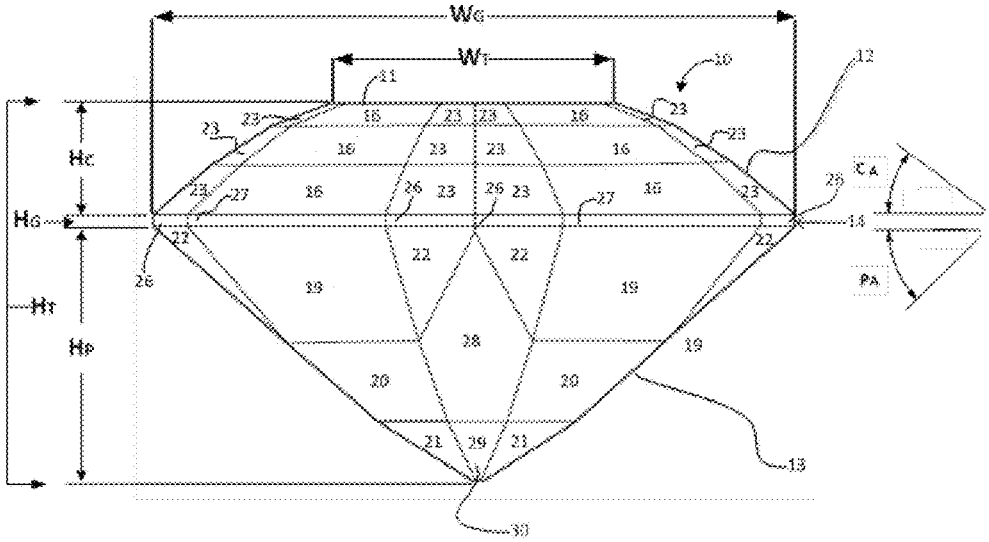
FIG. 3 shows a corner view of the front and right sides of an exemplary embodiment of a cushion step-cut gemstone. Additionally, FIG. 3 includes dimensional descriptions that provide the basis of a proportional analysis between the different dimensions and facets of a gemstone or diamond.

The example included in FIG. 3 indicates various parameters used to form a facet design for the examples of the cushion step-cut. The gemstone or diamond typically includes a width or girdle diameter ($W_G$), a table width ($W_T$), a height or total height ($H_T$), a pavilion height ($H_P$), a girdle height ($H_G$) with a corresponding girdle "thickness," and a crown height ($H_C$). The gemstone can be cut in a manner that includes specific proportions between the pavilion height and the crown height, between the width to the total height, between the table width and the girdle diameter, and so on.

In certain examples, the ratio of the width to the total height is 1.00 to 0.70-0.75. In other examples the ratio of the width to the total height is 1.00 to 0.65-0.80. In yet another example, the ratio of the width to the total height is 1.00 to 0.60-0.85.

In certain examples, the ratio of the width to the crown height is 1.00 to 0.20-0.25. In other examples the ratio of the width to the crown height is 1.00 to 0.22-0.24. In yet another example, the ratio of the width to the crown height is 1.00 to 0.15-0.30.

In certain examples, the ratio of the width to the pavilion height is 1.00 to 0.43-0.53. In another example, the ratio of the width to the pavilion height is 1.00 to 0.40-0.55. In still another example, the ratio of the width to the pavilion height is 1.00 to 0.45-0.50.

In yet another example, the ratio of the girdle width to the girdle height is 1.00 to 0.015-0.035. In one example, the ratio of the girdle width to the girdle height is 1.00 to 0.010-0.040. In another example, the ratio of the girdle width to the girdle height is 1.00 to 0.020-0.030.

In certain examples, the ratio of the width to the table width is 1.00 to 0.370-0.470. In one example, the ratio of the width to the table width is 1.00 to 0.375-0.465. In another example, the ratio of the width to the table width is 1.00 to 0.360-0.480. In one particular example, ratio of the width to the table width is 1.00 to 0.350-0.450.

In certain examples, ratio of the width to the pavilion height is 1.00 to 0.95-1.05. In certain examples, ratio of the width to the pavilion height is 1.00 to 0.97-1.03. In certain examples, ratio of the width to the pavilion height is 1.00 to 0.90-1.10.

In certain embodiments, the ratio of the width to the height is 1.00 to 0.716-0.726, the ratio of the width to the crown height is 1.00 to 0.210-0.220, the ratio of the width to the table width is 1.00 to 0.400-0.430, the ratio of the width to the pavilion height is 1.00 to 0.475-0.485, and the ratio of the width to the girdle height is 1.00 to 0.020-0.030. In other examples, the ratio of the width to the height is about 1.00 to 0.721, the ratio of the width to the crown height is about 1.00 to 0.216, the ratio of the width to the table width is about 1.00 to 0.423, the ratio of the width to the pavilion height is about 1.00 to 0.481, and the ratio of the width to the girdle height is about 1.00 to 0.024. In other embodiments, the ratio of the width to the pavilion height is 1.00 to 0.95-1.05. In another embodiment, the ratio of the width to the pavilion height is 1.00 to 0.99-1.01.

The descriptions of girdle thickness include extremely thin, thin, medium, slightly thick, thick, and extremely thick. In one particular example, the girdle thickness is "thin." In another example, the girdle thickness is "extremely thin." In another embodiment, the girdle thickness is "medium."

As depicted in FIG. 3, the pavilion angle is defined as the angle at which the main facets of a gemstone pavilion intersect with the plane of the girdle. The crown angle is defined as the angle of the lower crown facets relative to the gemstone girdle. Various embodiments of this disclosure incorporate a table height that is relatively high compared to other prior designs. As a result, some examples include a gemstone pavilion angle ($P_A$) that is about 44.3 degrees. Certain examples include a crown angle ($C_A$) that is about 37.0 degrees. As other representative examples, the pavilion angle may be about 44 to 45 degrees, and the crown angle may be about 36 to 40 degrees. In some examples, the pavilion angle is about 42 to 46 degrees and/or the crown angle is about 35 to 42 degrees. In other examples, the pavilion angle is 35 degrees or more. In certain examples, the pavilion angle is 40 degrees or more. In still other examples, the pavilion angle is 43 degrees or more. In some embodiments, the crown angle is 30 degrees or more. In some examples, the crown angle is 35 degrees or more. In one particular example, the crown angle is 40 degrees or more. In various examples, the gemstone has a crown angle, and each successive row of the crown, until the table is reached, has a relatively smaller angle as compared to the top of the row. As a representative example, a gemstone may have a crown angle of about 37.0 degrees for a step-cut facet immediately above the girdle, and the step-cut facet immediately above it that has an angle slightly less than 37.0 degrees, as compared to the top edge of the step-cut facet immediately above the girdle (e.g. 36.0 degrees or 35.0 degrees).

Fluorescence refers to a diamond's ability to emit a slight, sometimes colored, glow when subjected to ultraviolet (UV) light from the sun or when artificially exposed to UV light in the laboratory. Fluorescence is the reaction of trace minerals within the diamond that cause the diamond to glow when exposed to ultraviolet light. The fluorescence has various strength levels. The range of strengths as reported on laboratory grading reports often include: None, Faint, Medium, Strong, Very Strong. Some labs use the term "Negligible" for any diamond with no fluorescence or "Faint" fluorescence. In certain examples, the diamond or gemstone has a light fluorescence rating of "Negligible."

Figure 7:
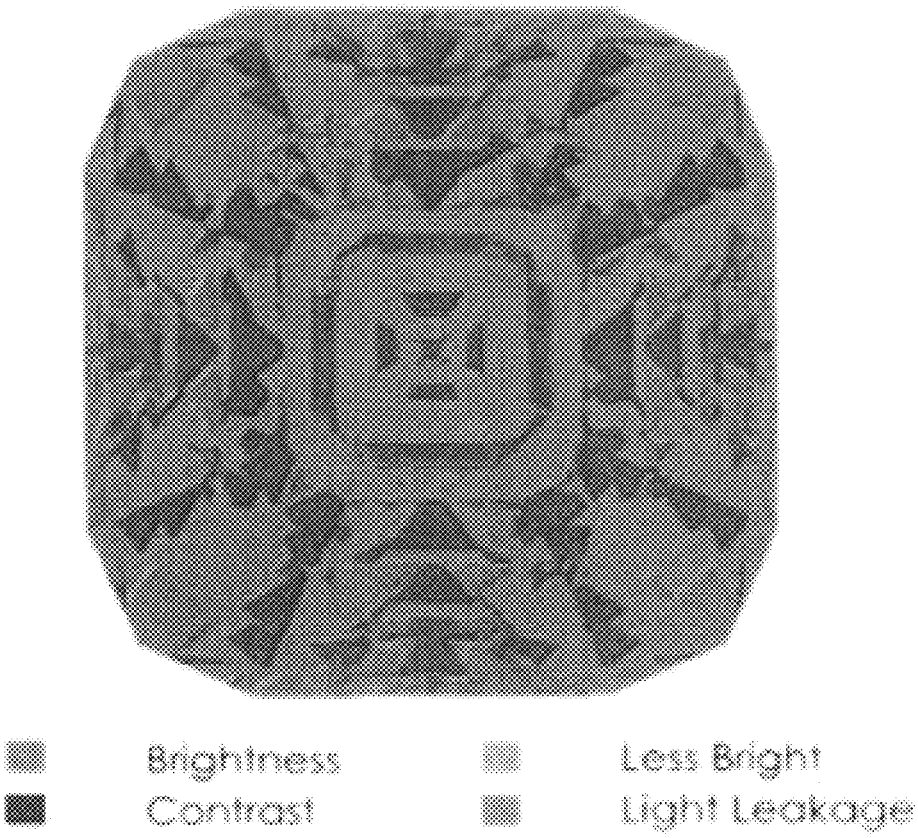
FIG. 7 provides a light performance map of an example gemstone embodiment, as measured through the AGSL method referenced below.

The American Gem Society Laboratories (AGSL) created a scientifically based system for grading gemstone and diamond cutting. AGSL U.S. Pat. No. 7,355,683 describes a system and method to quantify the dispersion of a diamond, which can then be used to create a map or other indicator of a diamond's fire potential. The system evaluates the performance of light in the stone. In some examples (in this and the following exemplary embodiments, the characteristics of the gemstone as measured by the system are provided as the gemstone is rated viewing it from above), the gemstone has a balanced amount of "contrast," as measured and indicated by the system, where the contrast may be scattered between or contained within areas that are graded as "brightness" and/or "less bright." In certain examples, the gemstone comprises twelve areas or regions consisting or comprising portions of the gemstone rated as "contrast" between the edges of the table and the edges of the gemstone (as viewed from the top of the gemstone), these "contrast" areas being separated by areas rated as "brightness" and/or "less bright." In some examples, the "contrast" areas essentially correspond with the outer edges of the corner step-cut facet sections (for example, along the edge of a corner step-cut facet that meets a trapezoidal step-cut fact, but not the edge of a corner step-cut facet that meets another corner step-cut facet), and the middle of the step-cut facet rows. In certain examples, the contrast areas comprise a plurality of essentially triangular and/or trapezoidal shaped areas of the gemstone having a "contrast" rating. FIG. 7 provides a light performance map of an example gemstone embodiment, as measured through the AGSL method, illustrating, inter alia, the areas of contrast within other areas rated as "brightness" and/or "less bright."

The balanced and scattered amount of contrast in example embodiments may increase the fire and scintillation of the light performance of the gemstone. In certain examples, only a minimal amount of "light leakage" is present in the gemstone as measured by the system. In certain examples, substantially all or all of the "light leakage," even if only present in small amounts, is disposed below the table (as the gemstone is viewed from the top). In certain embodiments, a majority of the table has a rating of "brightness."

Figure 8:
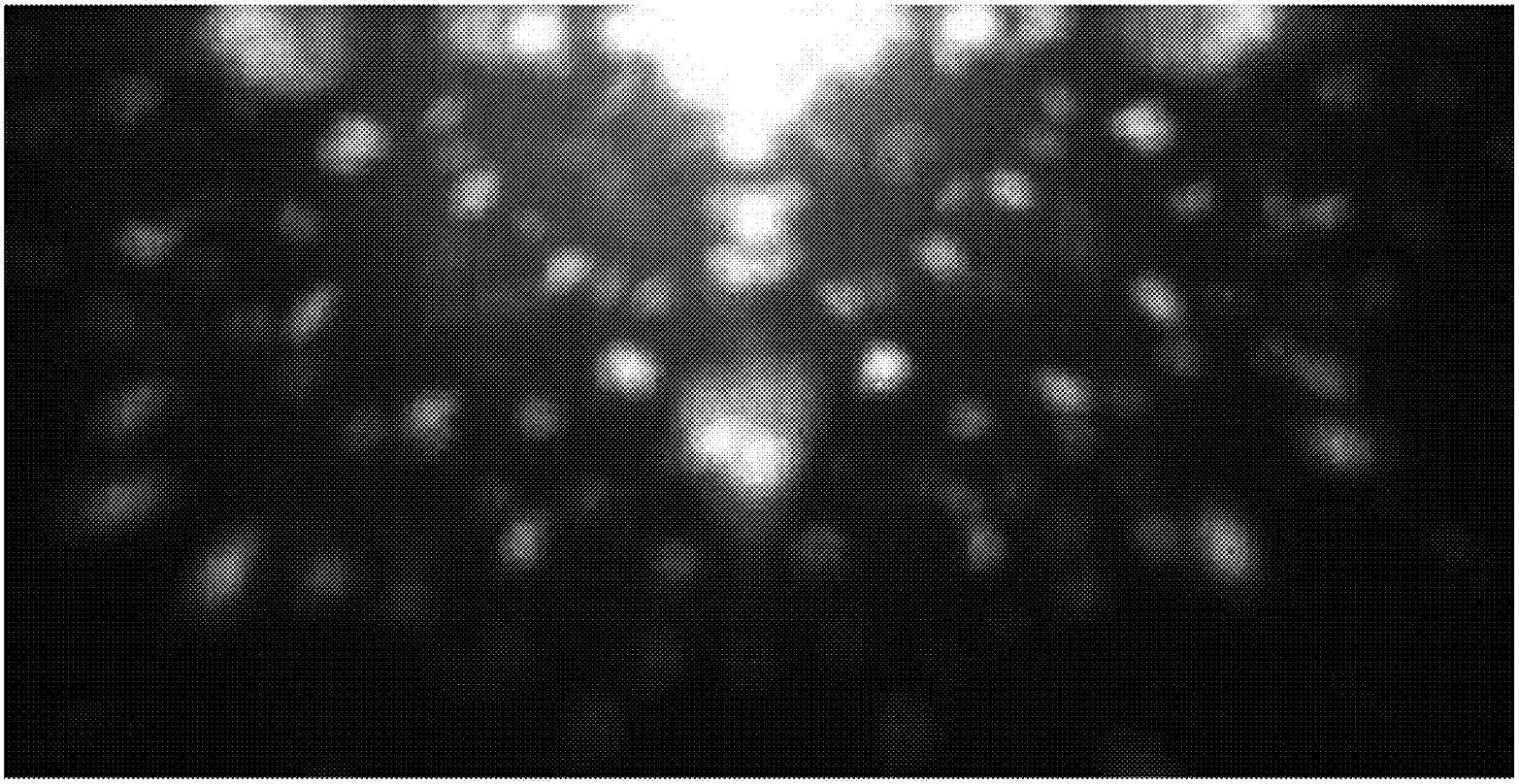
FIG. 8 provides a light performance image showing the light reflecting out of an example gemstone embodiment, wherein the image is cropped for clarity to primarily show the lower half of the light reflection.

Reflection or "mirror symmetry" is symmetry with respect to an object's reflection. In other words, an object does not change in its reflections if it has reflectional symmetry. If an object can be rotated about an axis and repeat itself every 90 degrees of rotation, then it is said to have "four-fold mirror-image symmetry" or "rotational symmetry." The axis along which the rotation is performed is an element of symmetry referred to as a "rotation axis." In a particular embodiment, the gemstone has four-fold mirror-image symmetry. FIG. 8 provides a photo image of the symmetrical light performance of an example gemstone embodiment, showing the light reflecting out of the gemstone after entering the through the table. For clarity, the provided image substantially only shows the lower half of the reflection only, as the gemstone itself obscured some of the upper portion of the reflection (i.e. the example show the lower half of the reflection and a small portion of the upper half, wherein the overall light reflection between the upper and lower half is symmetrical). In other examples, the gemstone is approximately square shaped. In yet others, the gemstone has two-fold mirror image symmetry, e.g. the gemstone is rectangular. For example, two opposite sections of the step-cut facet rows may be elongated as compared to the other step-cut facet rows to provide an essentially rectangular girdle shape.

In some examples, an article of jewelry is disclosed, such as a ring, including one or more gemstones as described herein. In other examples, the article of jewelry is a necklace or a bracelet, including a gemstone or multiple gemstones as described herein. In still other examples, the article of jewelry is an erring, including a gemstone as described herein.

Other aspects of the disclosure relate to methods of cutting a gemstone and/or methods of forming an article of jewelry. In some embodiments, the method comprises cutting a gemstone to include a crown, a girdle, and a pavilion with twelve straight-edged facets on the girdle that define four sides and four corners of the girdle. The four sides may each include one straight-edged facet and the four corners may each comprise two straight-edged facets meeting at a corner midpoint. The crown may comprise a table and two or more rows of step-cut facets between the table and the girdle. The step-cut facets may shaped like elongated trapezoids, and each step-cut row includes twelve step-cut facets.

In certain examples, the method comprises cutting a gemstone to include a crown, a pavilion, and a girdle that further includes twelve straight-edged facets on the girdle that define four sides and four corners of the girdle. In some examples, the method comprises cutting the gemstone to provide a gemstone comprising four sides each including one straight-edged facet and four corners each comprising two straight-edged facets. In some examples, the method comprises cutting the gemstone to provide a gemstone comprising a pavilion including four pavilion corners, each pavilion corner including an elongated, pentagonal facet and three triangular facets. In some examples, the method comprises cutting the gemstone to provide a gemstone comprising a width to height ratio that is 1.00 to 0.70-0.75, and/or a ratio of the width to the crown height of 1.00 to 0.20-0.25, and/or a ratio of the width to the table width of 1.00 to 0.35-0.45, and/or a ratio of the width to the pavilion height of 1.00 to 0.43-0.53, and/or a ratio of the width to the girdle height of 1.00 to 0.015-0.035.

In various embodiments, the method comprises cutting a gemstone to include a crown, a pavilion, and a girdle that includes four sides, each side comprising one rectangular facet, and four girdle corners, each girdle corner including two rectangular facets that meet at a corner midpoint. In some examples, the method comprises cutting the gemstone to provide a gemstone comprising a pavilion disposed beneath the girdle and comprising four pavilion corners that each include an elongated, pentagonal facet comprising a point meeting the corner midpoint, and three triangular facets. In some examples, the method comprises cutting the gemstone to provide a gemstone comprising a crown including a table and two or more rows of step-cut facets between the table and the girdle, where in some examples the step-cut facets are elongated trapezoids in shape, and each row includes twelve step-cut facets. In some examples, the method comprises cutting the gemstone to provide a gemstone comprising a gemstone ratio of the width to the height of about 1.00 to 0.721, and/or a ratio of the width to the crown height of about 1.00 to 0.216, and/or a ratio of the width to the table width of about 1.00 to 0.423, and/or a ratio of the width to the pavilion height of about 1.00 to 0.481, and/or a ratio of the width to the girdle height of about 1.00 to 0.024. In some examples, the method comprises polishing the gemstone. In other various examples, the method comprises attaching or coupling the gemstone (or multiple such gemstones) to a wearing component, including but not limited to a ring, necklace, bracelet, earring, and the like, to form an article of jewelry or another type of decorative article.

These method descriptions are merely exemplary. In certain embodiments, the process may include additional combinations or substitutions of some or all of the steps described above. What's more, any of the features discussed in the exemplary embodiments of the method may be features of embodiments of the gemstone and/or articles of jewelry, and any of the features discussed in the exemplary embodiments of the gemstone and/or articles of jewelry described above may be incorporated into the embodiments of the method, by, e.g., a method step resulting in such a feature. Moreover, additional and alternative suitable variations, forms and components for the method will be recognized by those skilled in the art given the benefit of this disclosure.

The present disclosure is disclosed above and in the accompanying drawings with reference to a variety of examples and embodiments. The purpose served by the disclosure, however, is to provide examples of the various features and concepts related to the disclosure, not to limit the scope of the disclosure.

What is claimed is:

1. A gemstone comprising:

a crown disposed above a girdle;

a pavilion disposed below the girdle;

wherein the girdle comprises:

twelve straight-edged facets defining four sides and four corners of the girdle, wherein the four sides each comprise one straight-edged facet and the four corners each comprise two straight-edged facets meeting at a corner midpoint;

wherein the pavilion comprises:

four pavilion corners meeting the four corners of the girdle, each pavilion corner comprising an elongated, pentagonal facet comprises a point meeting the girdle corner midpoint and three triangular facets;

wherein the crown comprises:

a table; and three rows of step-cut facets between the table and the girdle, the rows comprising side step-cut facets being elongated trapezoids in shape and corner step-cut facets, and each row comprising twelve step-cut facets; and a width, a height, a crown height, a table width, a pavilion height, a girdle height, and a girdle thickness;

wherein the ratio of the width to the height is 1.00 to 0.70-0.75, the ratio of the width to the crown height is 1.00 to 0.20-0.25, the ratio of the width to the pavilion height is 1.00 to 0.43-0.53, and the ratio of the width to the girdle height is 1.00 to 0.015-0.035.

2. The gemstone of claim 1, wherein the ratio of the width to the table width is 1.00 to 0.370-0.470.

3. The gemstone of claim 1, wherein the girdle thickness is "thin."

4. The gemstone of claim 1, wherein ratio of the width to the pavilion height is 0.95-1.05.

5. The gemstone of claim 1, wherein a crown angle is about 37.0 degrees.

6. The gemstone of claim 1, wherein a pavilion angle is about 44.3 degrees.

7. The gemstone of claim 1, wherein the gemstone has a light performance, as viewed from above, wherein the gemstone comprises twelve areas between edges of the table and the girdle that comprise portions of the gemstone rated as "contrast," as measured by the AGSL light performance evaluation system, the "contrast" areas being separated by areas rated as "brightness," "less bright," or a combination thereof, as measured by the AGSL light performance evaluation system.

8. The gemstone of claim 1, wherein the gemstone has a light fluorescence rating of "Negligible."

9. The gemstone of claim 1, wherein the gemstone has four-fold mirror-image symmetry.

10. A gemstone comprising:

a crown, a girdle, and a pavilion, wherein the girdle comprises twelve straight-edged facets defining four sides and four corners of the girdle, wherein the four sides each comprise one straight-edged facet and the four corners each comprise two straight-edged facets;

wherein the pavilion includes four pavilion corners;

wherein each pavilion corner includes an elongated, pentagonal facet and three triangular facets; and wherein the gemstone comprises a width, a height, a crown height, a table width, a pavilion height, and a girdle height; and wherein the ratio of the width to the height is 1.00 to 0.70-0.75, the ratio of the width to the crown height is 1.00 to 0.20-0.25, the ratio of the width to the table width is 1.00 to 0.35-0.45, the ratio of the width to the pavilion height is 1.00 to 0.43-0.53, and the ratio of the width to the girdle height is 1.00 to 0.015-0.035.

11. The gemstone of claim 10, wherein the ratio of the width to the height is 1.00 to 0.716-0.726, the ratio of the width to the crown height is 1.00 to 0.210-0.220, the ratio of the width to the table width is 1.00 to 0.400-0.430, the ratio of the width to the pavilion height is 1.00 to 0.475-0.485, and the ratio of the width to the girdle height is 1.00 to 0.020-0.030.

12. The gemstone of claim 10, wherein the gemstone has a light performance, as viewed from above, wherein the gemstone comprises twelve areas between edges of the table and the girdle that comprise portions of the gemstone rated as "contrast," as measured by the AGSL light performance evaluation system, the "contrast" areas being separated by areas rated as "brightness," "less bright," or a combination thereof, as measured by the AGSL light performance evaluation system.

13. The gemstone of claim 12, wherein the gemstone has a light fluorescence rating of "Negligible."

14. A gemstone comprising:

a crown, a girdle, and a pavilion;

wherein the girdle comprises four sides, each side comprises one rectangular facet, and four girdle corners, each girdle corner comprising two rectangular facets meeting at a corner midpoint;

wherein the pavilion is disposed beneath the girdle and comprises four pavilion corners;

wherein each pavilion corner includes an elongated, pentagonal facet comprises a point meeting the corner midpoint, and three triangular facets;

wherein the crown comprises a table and two or more rows of step-cut facets between the table and the girdle, the rows comprising side step-cut facets being elongated trapezoids in shape and corner step-cut facets, and each row comprising twelve step-cut facets;

wherein the gemstone further includes a width, a height, a crown height, a table width, a pavilion height, and a girdle height; and wherein the ratio of the width to the height is about 1.00 to 0.721, the ratio of the width to the crown height is about 1.00 to 0.216, the ratio of the width to the table width is about 1.00 to 0.423, the ratio of the width to the pavilion height is about 1.00 to 0.481, and the ratio of the width to the girdle height is about 1.00 to 0.024.

15. The gemstone of claim 14, wherein the gemstone has a light performance, as viewed from above, wherein the gemstone comprises twelve areas between edges of the table and the girdle that comprise portions of the gemstone rated as "contrast," as measured by the AGSL light performance evaluation system, the "contrast" areas being separated by areas rated as "brightness," "less bright," or a combination thereof, as measured by the AGSL light performance evaluation system, and wherein the gemstone has a light fluorescence rating of "Negligible."

16. The gemstone of claim 14, wherein ratio of the width to the pavilion height is 0.95-1.05; and wherein the crown consists of 36 step-cut facets and the table, the girdle consists of 12 rectangular facets; and the pavilion consists of 28 pavilion facets and a culet.

17. The gemstone of claim 16, wherein ratio of the width to the pavilion height is 0.99-1.01.

18. The gemstone of claim 14, wherein a crown angle is about 37.0 degrees and a pavilion angle is about 44.3 degrees.

* * * * *